US006689285B2

(12) United States Patent
Rusin et al.

(10) Patent No.: US 6,689,285 B2
(45) Date of Patent: Feb. 10, 2004

(54) PYROTECHNICAL AEROSOL-FORMING FIRE-EXTINGUISHING COMPOSITE AND A METHOD OF ITS PRODUCTION

(75) Inventors: Dmitriy Leonidovich Rusin, Moscow (RU); Anatoliy Petrovich Denisyuk, Moscow (RU); Dmitriy Borisovich Michalev, Korolev (RU); Juriy Germanovich Shepelev, Mytishtshi (RU)

(73) Assignee: Techno-TM LLC, Olympia, WA (US)

( * ) Notice: Subject to any disclaimer, the term of this patent is extended or adjusted under 35 U.S.C. 154(b) by 7 days.

(21) Appl. No.: 10/014,931

(22) Filed: Dec. 14, 2001

(65) Prior Publication Data

US 2002/0121622 A1 Sep. 5, 2002

(30) Foreign Application Priority Data

Dec. 15, 2000 (RU) ..... 2000131491

(51) Int. Cl.[7] ..... A62D 1/00

(52) U.S. Cl. ..... 252/3; 252/5; 149/70; 149/85

(58) Field of Search ..... 252/3, 5; 149/70, 149/85

(56) References Cited

U.S. PATENT DOCUMENTS 5,831,209 A * 11/1998 Kozyrev et al. ..... 149/21
5,865,257 A * 2/1999 Kozyrev et al. ..... 169/46
6,089,326 A * 7/2000 Drakin ..... 169/46
6,116,348 A * 9/2000 Drakin ..... 169/46

FOREIGN PATENT DOCUMENTS

EP 0 627 244 A1 12/1994
EP 0976424 A1 * 2/2000
RU 2005517 C1 1/1994
RU 2 091 105 C1 9/1997
RU 2 091 106 C1 9/1997

OTHER PUBLICATIONS

Bykov et al, RU 2091105C1, Eng. AB, Sep. 27, 1997.*
Barinov, RU 2150831C1, Eng. AB, Jun. 20, 2000.*
Dubrava et al, RU 2150310C1, Eng. AB, Oct. 6, 2000.*
Doronichev et al, RU 2091106C1, Eng. AB, Sep. 27, 1997.*
Baloyan, et al, RU 2022589C1, Eng. AB, Nov. 15, 1994.*
Emely Anov et al, RU 2153376 C1, Eng. AB, Jul. 27, 2000.*

* cited by examiner

*Primary Examiner*—Margaret Medley
(74) *Attorney, Agent, or Firm*—Rothwell, Figg, Ernst & Manbeck, p.c.

(57) ABSTRACT

Fire-fighting equipment utilizes a fire-extinguishing aerosol that is formed during burning of pyrotechnical composite. A pyrotechnical, aerosol-forming fire-extinguishing composite is formed with good deformation strength characteristics, low fire-extinguishing concentration and regulated burning velocity. The pyrotechnical aerosol-forming fire-extinguishing composite contains an oxidizer, a production process additive and burning binder formed by thermoplastic formaldehyde and phenol polycondensate, plasticized by dicarboxylic acid ester and reinforced by polytetrafluoroethylene. The composite is produced by mixing of formaldehyde and phenol polycondensate suspension in an organic solvent and polytetrafluoroethylene dispersion in dicarboxylic acid ester, mixing the resulting composition with an oxidizer and a production process additive with subsequent thermomechanical effect. The composite can be used for fire-extinguishing in different structures and devices without harmful effect on human body, living organisms and nature.

7 Claims, 1 Drawing Sheet

PYROTECHNICAL AEROSOL-FORMING FIRE-EXTINGUISHING COMPOSITE AND A METHOD OF ITS PRODUCTION

BACKGROUND OF THE INVENTION

1. Field of the Invention

This invention relates to the field of fire-fighting equipment, specifically to means of fire fighting by a fire-extinguishing aerosol that is formed during burning of products made from pyrotechnical compounds.

Products made from aerosol-forming compounds are used in devices for fire fighting mainly in closed volumes, such as:

warehouses, garages and shop premises vehicle compartments

2. Description of the Background Art

Efficiency of aerosol-forming fire-extinguishing compounds and products made from such compounds is assessed proceeding from its ability to meet a whole complex of requirements:

- high fire-extinguishing efficiency at a minimum fire-extinguishing concentration;
- low toxicity and explosion hazardness of burning products since they contain a minimum amount of underoxidated (NO, CO) and explosion-hazard ($H_2$) components;
- low burning temperature;
- high level of deformation strength characteristics which makes it possible to avoid negative effects of various factors (vibration, impacts, temperature fluctuations) in transit and storage and to produce and use products with a minimum burning arch thickness;
- a wide range of the compound burning velocity variation at atmospheric pressure, preferably without the use of special-purpose burn promoters and without
- posing special high requirements for dispersity and fraction composition of source components;
- low specific molding pressure which makes it possible to manufacture articles using a safe, low power-consuming and highly efficient production process.

Known pyrotechnical fire-fighting means consist mainly of the following components:

- an oxidizer (generally nitrates or perchlorates of alkali metals and mixture thereof);
- a burning binder selected from a series of epoxy or polyester resins, synthetic or natural rubbers, thermally plasticized rubbers and mixtures thereof;
- production process and functional additives.

A fire-fighting compound is known (Patent RU 2095104, A . . . , Nov. 10, 1997) containing in percent by mass the following components: 1.5–1.8 burning binder; 5.0–20.0 coolant and the remainder—oxidizer. As a burning binder the following is used: 4-hydroxybenzoic acid or a mixture of 4-hydroxybenzoic acid and phenol-formaldehyde and epoxy resins, or a mixture of 4-hydroxybenzoic acid and epoxy resin, or a mixture of phenol-formaldehyde and epoxy resins, or a mixture of 4-hydroxybenzoic acid, phenol-formaldehyde and epoxy resins. As oxidizer it is allowed to use potassium nitrate or sodium nitrate, or potassium perchlorate, or sodium perchlorate, or a mixture thereof. Dicyandiamide or melem, or melamine, or urea, or urotropin, or azobisformamide or mixtures thereof are used as a coolant. The compound can also contain production process additives and burning promoters at a rate of 0.1–5.0% by mass.

The compound production method includes charging of a mixer with an oxidizer, burning binder, production process additives and burning promoters and mixing them for one hour. According to example 3 the compound consisting, % by mass, of potassium nitrate—60; sodium nitrate—8; 4-hydroxybenzoic acid—9; phenol-formaldehyde resin—8; dicyandiamide—12; CuO—2; and polytetrafluoroethylene—1, shall be mixed in a mixer for one hour. After this the resulting mass shall be used to form articles of required geometry by the method of blind die pressing at specific pressure 1500 kg/cm$^2$ (150 MPa).

The compound and its production method have a serious drawback lying in the fact that in order to ensure its practical utilization of the compound, charges shall be pressed at high specific pressure 1000–1500 kg/cm$^2$(100–150 MPa). This requirement results, on the one hand, in enhanced hazard in processing the compound and, on the other hand, the high level of specific pressure during the compound processing makes it possible to apply a more efficient, safe and less power-consuming production process of the compound pressure by the method of continuous pressing using a screw press.

Compounds made by the blind die pressing are characterized by enhanced brittleness even at room temperature. Relative deformation value at rupture does not exceed 2%.

The most close analogue is the compound and the method of its production protected by patent RU 2005517, A . . . , Jan. 15, 1994. According to example 1 the compound includes, % by mass, $KClO_4$—39.5; $KNO_3$—38.5; PVA (polyvinyl acetate)—8.8; dibutyl phthalate—3.5; iditol—5.0; liquid petrolatum—1.0; KCl—1.0; carbon—0.2; polytetrafluoroethylene—1.5; and stearate—1.0.

The compound production method includes mixing pure PVA (and only after this adding to the mixer up to 10% of water) or adding in two or three steps a 30–35% water dispersion containing $KClO_4$, $KNO_3$, and KCl. The mixture shall be stirred for 20–30 minutes and then all the additives shall be added. After this the mixture shall be stirred at a negative pressure for one hour. The processed semi-finished product shall be discharged from the mixer and passed for rolling. The semi-finished product shall be rolled from 12 to 20 times at 70–90° C. to make it flat. The flat product shall be folded and passed to formation operation on a hydraulic press at 60–90° C. and a pressure not less than 1000 kgf/cm$^2$ to obtain round blanks of up to 70 mm in diameter, with or without a channel.

This compound and the method of its production have several significant shortcomings:

- high fire-extinguishing concentration of the compound—27 g/m$^3$;
- high specific pressure required to form articles from the compound—at least 1000 kgf/cm$^2$ (100 MPa);
- unsteady burning of the compound (at a pressure of 2–20 at it is necessary to add such special-purpose burning modifiers as carbon);
- unsteady inflammation due to residual moisture content of the main aerosol-forming ingredients ($KClO_4$, $KNO_3$). Moisture of the $KClO_4$, $KNO_3$ particles results in impaired adhesion of them to the polymeric binder surface and this, in its turn, leads to a drastic decrease in the strength characteristics of the finished product.

The indicated shortcomings depend on chemical characteristics of used components and their mass ratio. During combustion high and unbalanced content of combustibles in the compound leads to underoxidation of decomposition products of the main (PVA) and additional (iditol) burning binder because of insufficient quantity of oxidizer's oxygen. Hence it follows high content of toxic underoxidated and explosion-hazard gases in products of burning, unsteady inflammation and combustion of the composite. Because of technological problems selection of the burning binder pair: main (PVA) and additional (iditol) leads to a necessity to use PVA water dispersion. That leads to $KClO_4$ and $KNO_3$ moistening, and as a result to instability during the composite inflammation and combustion, impossibility to reach high level of deformation strength characteristics of the composite, to a necessity to use high specific molding pressure.

SUMMARY OF THE INVENTION

This invention solves the following technical tasks:

- ensuring of burning stability and increasing burning velocity and, hence, enhancing gas and aerosol formation speed;
- enhancing the level of deformation strength characteristics;
- decreasing the fire-extinguishing concentration;
- decreasing level of toxicity and explosion risk of the burning products due to decrease of content of fraction of incompletely oxidized and explosion hazard gases;
- decreasing the specific pressure of the compound formation and, as a consequence, lowing the hazard level and also making it possible to use highly efficient and less power-consuming production process using the continuous pressing method.

The technical tasks are solved by using the new composite and the claimed method of its production.

DETAILED DESCRIPTION OF THE INVENTION

Figure 1:
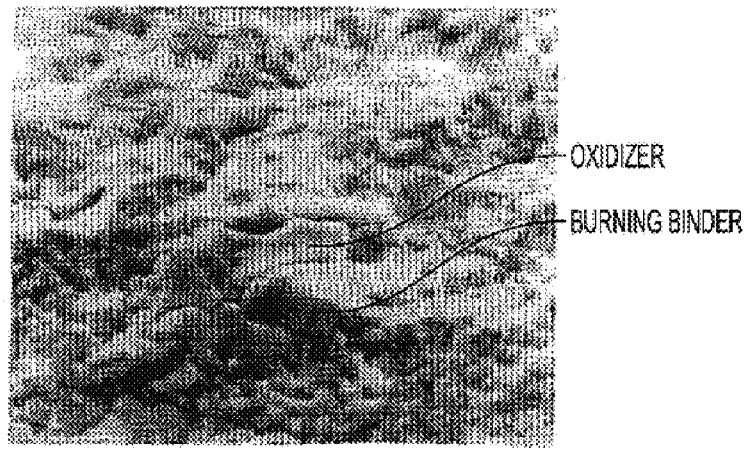
FIG. 1 shows the photo of the composite of three-dimensional structure comprising the following: 20% $KClO_4$; 64% $KNO_3$; 0.4% calcium stearate; 11.1% iditol; and 2.5% dibutyl phthalate without reinforcing polytetrafluoroethylene.

The pyrotechnical aerosol-forming fire-extinguishing composite of a three-dimentional structure contains an oxidizer, a production process additive and a burning binder formed by thermoplastic formaldehyde and phenol polycondensate, plasticized by dicarboxylic acid ester, and reinforced with polytetrafluoroethylene.

In claimed pyrotechnical aerosol-forming fire-extinguishing composite a three-dimensional structure is a spatial formation of hard particles of oxidizers ($KNO_3$, $KClO_4$) and layers of burning binder between hard particles, burning binder formed by thermoplastic formaldehyde and phenol polycondensate, plasticized by dicarboxylic acid ester and polytetrafluoroethylene. Polytetrafluoroethylene particles form an ordered structure in thermoplastic formaldehyde and phenol polycondensate, plasticized by dicarboxylic acid ester. The ordered structure plays a role of reinforcement and is extended chains from polytetrafluoroethylene particles with a cross section of 0.1–2.0 $\mu$m.

In this compound, formaldehyde and phenol polycondensate—phenol-formaldehyde resin (iditol) is used as the burning binder; dibutyl-phthalate or dioctyl sebacate, or mixture thereof is used as dicarboxylic acid ester; stearate selected from the series of potassium stearate, sodium stearate, calcium stearate or mixtures thereof are used as the production process additive; and nitrate, perchlorate of alkali metals or a mixture thereof is used as the oxidizer.

The composite contains the components in the following ratios, % by mass: polytetrafluoroethylene—1–5; thermoplastic formaldehyde and phenol polycondensate—8–11; dicarboxylic acid ester—2–6; production process additive—0.2–0.5; and oxidizer—the remainder.

To produce the claimed composite it is necessary to prepare formaldehyde and phenol polycondensate suspension in an organic solvent for which purpose it is necessary to take 10–15% methylene chloride or carbon tetrachloride, or a mixture thereof to ensure the safe mixing procedure and exclude the powder components dusting. While stirring, polytetrafluoroethylene suspension in dicarboxylic acid ester shall be added to the resulting suspension and then the composition shall be mixed with the oxidizer with simultaneous addition of a required amount of the production process additive. The production process additive, selected from the metallic stearates series, possesses surface-active properties. During mixing the oxidizer's surface is being modified by absorbing on its polar surface of the stearate bifilar molecule and this makes it possible to reduce external friction of the composition at the stage of molding (at 70–90° C.). The production process additive concentration of less than 0.2% slightly reduces external friction, while the production process additive concentration over 0.5% ensures a drastic reduction of the external friction, but decreases oxidizer's adhesion to the burning binder and this results in a considerable reduction of the composite strength properties.

In doing so no stringent requirements are placed upon dispersity and fraction composition of the oxidizer. It is necessary to use potassium nitrate and/or potassium perchlorates with specific surface area of 1000–1500 $cm^2/g$ and moisture content not more than 0.5%.

The resulting mixture shall be exposed to thermomechanical effect on rollers at 70–90° C. During this operation the following process take place:

- the oxidizer is reduced in size and uniformly distributed in the burning binder volume;
- the dicarboxylic acid ester plastisizes formaldehyde and phenol polycondensate to ensure optimum viscous-flow characteristics of the burning binder and the whole composite;
- a simultaneous flow of plastisized formaldehyde and phenol polycondensate and polytetrafluoroethylene. As a result of polytetrafluoroethylene thermodynamical incompatibility with formaldehyde and phenol polycondensate in normal conditions it can't uniformly distribute in formaldehyde and phenol polycondensate volume. But during thermoplastic deformation at the set temperature, intensity and duration of a shear deformation there are conditions of their simultaneous flow, as a result of which migration of polytetrafluoroethylene particles between the layers of plastisized formaldehyde and phenol polycondensate takes place.

Intensity and duration of the thermomechanical effect during rolling shall be set to ensure the following condition: $1000<j_s<3000$, where $j_s$ is a dimensionless parameter which determines total deformation. For the stage of rolling $j_s$ at the set temperature 70–90° C. is:

$$j_s=j\cdot t,\ [s^{-1}\cdot s] \tag{1}$$

In this case shear rate is $$j=\frac{V}{\frac{\delta}{2}},\ [s^{-1}],\ \text{where} \tag{2}$$

δis a roller-to-roller gap

V is linear velocity of composite movement.

In its turn $$V=\pi\cdot D\cdot n, \tag{3}$$

where n is the rollers rotation speed

D is the rollers diameter.

By knowing length L it's possible to find t $$t=L/V \tag{4}$$

In one pass a layer of composite of length equal to length of roller circle passes through the roller-to-roller gap $$L=\pi\cdot D \tag{5}$$

In m passes, accordingly $$L=m\cdot\pi\cdot D \tag{6}$$

Then effect time is $$t=L/V=m\cdot\pi\cdot D/\pi\cdot D\cdot n=m/n,\ [s] \tag{7}$$

Insert equations 2 and 7 into equation 1, then $$j_s=j\cdot t=\frac{\pi\cdot D\cdot n\cdot m}{\frac{\delta\cdot n}{2}}=\frac{\pi\cdot D\cdot m}{\frac{\delta}{2}} \tag{8}$$

Taking into consideration part of composite circulating above roller-to-roller gap and subjected to mixing, lets introduce coefficient K which was determined experimentally, and which value can be in the range of 0.133–0.222 depending on component composition and rollers dimensions.

So, the final equation is:

$$j_s=\frac{\pi\cdot D\cdot m\cdot K}{\frac{\delta}{2}} \tag{9}$$

Preferred embodiments for realization of the composite and the method according to the invention are described below.

EXAMPLE 1

To prepare 1 kg of the pyrotechnical aerosol-forming fire-extinguishing composite it is necessary to charge a paddle mixer with the following components: 111 g of formaldehyde and phenol polycondensate with specific surface area 1500 $cm^2/g$ and 19.59 g of methylene chloride to obtain a 85% suspension. The suspension shall be prepared in a reactor with water jacket at 20–25° C. and a mixer rotating at 85 rpm. Duration of mixing shall be 15 minutes.

To the suspension it is necessary to add 45 g of polytetrafluoroethylene dispersion in butyl phthalate taken at a ratio 20:25. The suspension shall be prepared in a reactor with water jacket at 20–25° C. and a mixer rotating at 85 rpm. Duration of mixing shall be 10 minutes.

To the resulting suspension mixture containing formaldehyde and phenol polycondensate in methylene chloride and polytetrafluoroethylene dispersion in dibutyl phthalate it is necessary to add in two steps 640 g of potassium nitrate with specific surface area 1500 $cm^2/g$ and then 200 g of potassium perchlorate with specific surface area 1500 $cm^2/g$. To the resulting mixture it is necessary to add 4 g of calcium stearate and then stir the composition for 10 minutes. The ready mass shall be transferred to rollers with roller diameter D=100 mm at rotation speed n=10 $min^{-1}$, ensuring a roller-to-roller gap δ=1 mm. The mass shall be processed on the rollers for 15 minutes at 80° C. After this the flat mass shall be additionally passed through the roller-to-roller gap at 80° C. 20 times. Total deformation during rolling in this case was $j_s$=2094.

The ready flat mass shall be placed in the molding press to obtain an article of a given geometry by the continuous pressing method at 80° C. and pressure 50 MPa.

The composite shall be tested by standard test methods. By burning at atmospheric pressure it is necessary to determine linear velocity of burning ($U_{0.1}$) and fire-extinguishing concentration in a 80 $dm^3$ box. Deformation ($\epsilon_p$) and strength ($\sigma_p$) characteristics shall be determined during stretching the material in one axis using two double-sided blades at speed 0.21 mm/s at 20° C. and also during shearing of cylindrical samples ($\sigma_{mean}$) at 40–80° C. and speed 0.21 mm/s.

Table 1 shows relationship between the operation characteristics of the claimed pyrotechnical aerosol-forming fire-extinguishing composite of the following composition: 20% $KClO_4$; 64% $KNO_3$; 2% polytetrafluoroethylene; 0.4% calcium stearate; 11.1% iditol; and 2.5% dibutyl phthalate (samples 1-4 and sample 5 without polytetrafluoroethylene) and operation conditions of a method of its preparation.

From Table 1 data it is evident that the composite of sample 4 produced at thermomechanical effect by rolling, intensity and duration of which meet the requirement that total deformation $j_s$=2094, has the best set of operation characteristics.

Composites of samples 1 and 2 produced without rolling stage (without plastic deformation) show the low operation characteristics.

If to compare samples 3 and 4, it's evident that rolling stage (plastic deformation), total deformation $j_s$ of which is above 1000, ensures the best operation characteristics.

Table 2 shows relationship between operation characteristics and thermodynamic parameters of pyrotechnical aerosol-forming fire-extinguishing composites and formulation of their initial components and total deformation value $j_s$ during rolling.

The data given in Table 2 show that the composites in the claimed range of relationships between the material components and total deformation value $j_s$ during the composite rolling meeting the condition $1000<j_s<3000$ feature the best set of operation characteristics and the least concentration of toxic (CO) and explosion hazardous gases ($H_2$) in combustion products.

Figure 2:
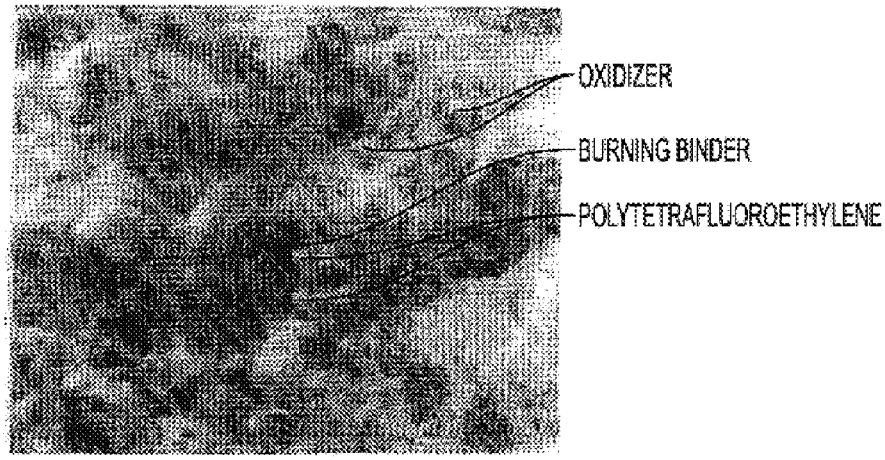
FIG. 2 shows the photo of the composite of three-dimensional structure with burning binder reinforced with polytetrafluoroethylene comprising the following: 20% $KClO_4$; 64% $KNO_3$; 2% polytetrafluoroethylene; 0.4% calcium stearate; 11.1% iditol; and 2.5% dibutyl phthalate.
Figure 3:
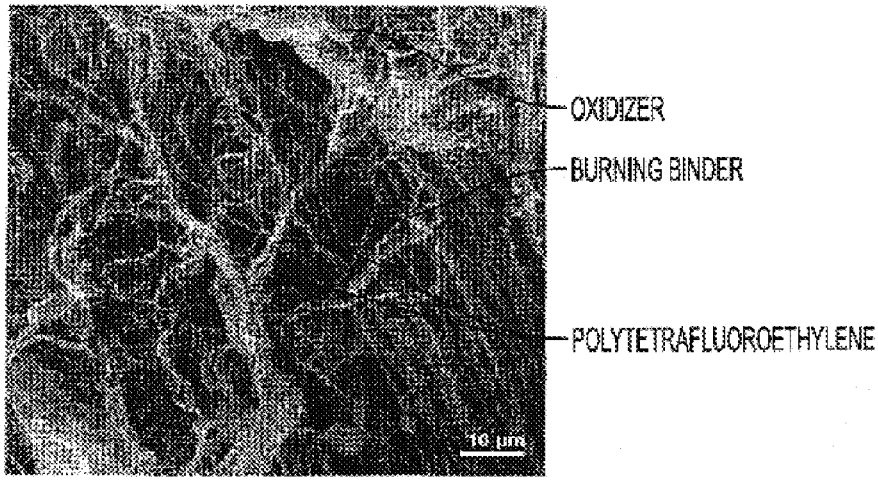
FIG. 3 shows the photo of the composite of three-dimensional structure with burning binder reinforced with polytetrafluoroethylene comprising the following: 80% $KNO_3$; 2.5% polytetrafluoroethylene; 0.4% calcium stearate; 11.65% iditol; and 5.45% dioctyl sebacate.

The composites were produced according to above described method, their electronic photos made on electron-scan microscope are shown in FIGS. 1–3.

Comparison of photos of the composites in FIGS. 1, 2 and 3 shows that in FIG. 2 and FIG. 3 polytetrafluoroethylene particles are formed into extended reinforcing chains.

Previously it hasn't been known pyrotechnical aerosol-forming fire-extinguishing compounds of three-dimensional structure with reinforced burning binder, a namely formed by thermoplastic formaldehyde and phenol polycondensate, plasticized by dicarboxylic acid ester and reinforced polytetrafluoroethylene. The technical obtained results couldn't be forecast or obtained in advance by calculation using known calculation techniques. The composition consists at least of five components varying by their physical and chemical characteristics and exerting different complex effect on one another both at production of the composite and during its use for fire-fighting purposes.

The novelty of the method of production of the claimed composite consists in using thermomechanical effect by means of rolling at the set temperature 70–90° C. and the total deformation value ($j_s$) meeting the following condition: $1000<j_s<3000$, and molding at the temperature 70–90° C.

TABLE 1

Relationship between operation characteristics of the claimed pyrotechnical aerosol-forming fire-extinguishing composite (20% $KClO_4$; 64% $KNO_3$; 2% polytetr afluoroethylene; 0.4% calcium stearate; 11.1% iditol; 2.5% dibutyl phthalate) and operation conditions of a method of its preparation

| | | Thermomechanical effect | | | Operation characteristics | | | |
|---|---|---|---|---|---|---|---|---|
| No of sample | Operations | T, ° C. | Molding pressure P, MPa | Total deformation force during rolling $j_s$ | Shearing strength $\sigma_p$, MPa at temperature, ° C. 40 | 80 | Velocity of burning $U_{0.1}$ mm/s | Fire extinguishing concentration, g/m$^3$ |
| 1 | Without rolling, blind, cold pressing | 20° C. | 120 | — | 2.10 | 0.83 | 3.0 | 33.2 |
| 2 | Without rolling, blind, hot pressing | 80° C. | 80 | — | 2.65 | 1.24 | 4.0 | 25.3 |
| 3 | Rolling; blind, cold pressing | 80° C. | 80 | 950 | 4.88 | 1.50 | 5.4 | 11.9 |
| 4 | Rolling, continuous pressing | 80° C. | 50 | 2094 | 13.6 | 3.08 | 7.1 | 9.0 |
| 5 | Rolling; continuous pressing, sample is without polytetrafluoroethylene | 80° C. | 70 | 2094 | 1.50 | 1.07 | 4.7 | 16.5 |

TABLE 2

Relationship between operation characteristics and thermodynamic parameters of pyrotechnical aerosol-forming fire-extinguishing composites and formulation of their initial components and total deformation value $j_s$

| Components, % by mass. | Sample 2 | Sample 3 | Sample 4 | Sample 5 | Sample 6 | Sample 7 | Sample 8 | Sample 9 |
|---|---|---|---|---|---|---|---|---|
| $KNO_3$ | 64 | 82 | 82 | 82 | 74 | 62 | 83 | 80 |
| $KClO_4$ | 20 | 0 | 0 | 0 | 10 | 20 | 0 | 3 |
| Phenol-formaldehyde resin | 8.0 | 10.5 | 8.9 | 11.3 | 8.0 | 10.7 | 8.5 | 8.0 |
| Polytetrafluoro-ethylene | 2.5 | 1.5 | 5.0 | 0 | 2.5 | 1.0 | 3.5 | 5.0 |
| Dioctyl sebacate | 2.0 | 5.5 | 3.6 | 6.2 | 0 | 5.8 | 4.0 | 0.3 |
| Dibutyl phthalate | 3.0 | 0 | 0 | 0 | 4.8 | 0 | 0 | 3.0 |
| StZn | 0.2 | 0 | 0 | 0 | 0.3 | 0 | 0.5 | — |
| StNa | 0.2 | 0 | 0 | 0 | 0.2 | 0 | — | 0.1 |
| StCa | 0.1 | 0.5 | 0.5 | 0.5 | — | 0.5 | — | 0.2 |
| Total deformation of material $j_s$ | 2500 | 800 | 4000 | 3000 | 1000 | 2000 | 2500 | 3000 |
| Data of thermodynamical calculations | | | | | | | | |
| Excess oxidizer ratio, $\alpha$ | 1.022 | 0.815 | 0.991 | 0.761 | 1.028 | 0.817 | 0.947 | 1.012 |

TABLE 2-continued

Relationship between operation characteristics and thermodynamic parameters of pyrotechnical aerosol-forming fire-extinguishing composites and formulation of their initial components and total deformation value $j_s$

| Components, % by mass. | Sample 2 | Sample 3 | Sample 4 | Sample 5 | Sample 6 | Sample 7 | Sample 8 | Sample 9 |
|---|---|---|---|---|---|---|---|---|
| Temperature of burning, $T_F$, K | 1764 | 1588 | 1721 | 1553 | 1728 | 1607 | 1661 | 1712 |
| CO in products of burning, mole/kg | 0.0103 | 4.1728 | 0.0081 | 5.4912 | 0.006 | 4.399 | 0.9995 | 0.007 |
| $H_2$ in products of burning, mole/kg | 0.0007 | 1.3126 | 0.0008 | 2.2592 | 0.0004 | 1.039 | 0.1467 | 0.001 |
| Volume of gaseous products of burning V, $m^3$/kg | 3.291 | 2.839 | 2.832 | 2.831 | 3.015 | 3.252 | 2.935 | 3.001 |
| Operation characteristics | | | | | | | | |
| Strength, $\sigma p$, MPa | 6.0 | 3.1 | 3.0 | 1.5 | 4.5 | 3.3 | 6.8 | 8.7 |
| Breaking strain, $\epsilon_p$, % | 37 | 15 | 50 | 2 | 33 | 10 | 39 | 46 |
| Velocity of burning $U_{0.1}$, mm/s | 7.0 | 3.0 | 3.3 | 2.0 | 5.3 | 5.9 | 3.7 | 5.2 |
| Fire extinguishing concentration, g/$m^3$ | 10 | 20 | 17 | 45 | 14 | 11 | 16 | 11 |

The proposed pyrotechnical aerosol-forming fire-extinguishing composite produced by the claimed method makes it possible to carry out efficient fire-fighting of various combustible materials in such structures and devices as:

warehouse, garages, shop premises;

offices rooms for holding animals and birds;

engine and luggage compartments of transport vehicles;

ventilation systems of industrial enterprises, hotels, etc.

Advantages of the proposed composite are a wide availability of raw materials for the composite components and complex of high operation characteristics, such as low fire-extinguishing concentration, high level of deformation strength characteristics, durability and reliability during usage, possibility to regulate burning velocity without the use of special-purpose catalysts. The fire-extinguishing gas-aerosol mixture exerts no harmful effect on human body and living organisms, nature, and high-altitude apparatus and equipment.

Advantages of method of its production are possibility to use widely available delivery sets of parts for its implementation, low molding pressure, simplicity and safety of the production.

What is claimed is:

1. A pyrotechnical aerosol-forming fire-extinguishing composite of three-dimensional structure comprising an oxidizer, a production process additive, a burning binder including thermoplastic formaldehyde and phenol polycondensate, a dicarboxylic acid ester, and polytetrafluoroethylene.

2. The pyrotechnical aerosol-forming fire-extinguishing composite according to claim 1 wherein the polytetrafluoroethylene constitutes 1–5% of the composite mass, the burning binder constitutes 8–11% of the composite mass, the dicarboxylic acid ester constitutes 2–6% of the composite mass, the production process additive constitutes 0.2–0.5% of the composite mass and the oxidizer constitutes the remainder of the composite mass.

3. The pyrotechnical aerosol-forming fire-extinguishing composite according to claim 1, where the dicarboxylic acid ester is selected from the group consisting of dibutyl phthalate, dioctyl sebacate, and a mixture thereof.

4. The pyrotechnical aerosol-forming fire-extinguishing composite according to claim 1, where the production process additive is selected from the group consisting of sodium stearate, potassium stearate, calcium stearate, and a mixture thereof.

5. The pyrotechnical aerosol-forming fire-extinguishing composite according to claim 1, where the oxidizer is selected from the group consisting of nitrate, perchlorate of alkali metals, and a mixture thereof.

6. A method of producing the pyrotechnical aerosol-forming fire-extinguishing composite according to claim 1 which comprises mixing of formaldehyde and phenol polycondensate suspension in an organic solvent and polytetrafluoroethylene dispersion in dicarboxylic acid ester and then mixing the resulting composition with an oxidizer and a production process additive with subsequent thermomechanical effect at 70–90° C. by rolling, intensity and duration of which meets the condition: $1000<j_s<3000$, where $j_s$ is a total deformation, and by molding.

7. The method of producing the pyrotechnical aerosol-forming fire-extinguishing composite according to claim 6, in which the organic solvent is selected from the group consisting of methylene chloride, carbon tetrachloride, and a mixture thereof.

* * * * *